US005815953A

United States Patent [19]

Kaufman et al.

[11] Patent Number: 5,815,953

[45] Date of Patent: Oct. 6, 1998

[54] DOWNHILL SNOW SPORT BOOT ASSEMBLY

[75] Inventors: William H. Kaufman, Kitchener, Canada; Edward L. Chalmers, Vail; Thomas W. Corlett, Boulder, both of Colo.

[73] Assignee: William H. Kaufman Inc., Kitchener, Canada

[21] Appl. No.: 828,788

[22] Filed: Mar. 27, 1997

Related U.S. Application Data

[63] Continuation-in-part of Ser. No. 622,216, Mar. 27, 1996, abandoned.

[51] Int. Cl.[6] ..... A43B 5/04

[52] U.S. Cl. ..... 36/118.3; 36/118.9; 36/117.3; 36/117.8

[58] Field of Search ..... 36/117.1, 117.4, 36/118.2, 118.3, 118.9, 118.4, 117.3, 117.8

[56] References Cited

U.S. PATENT DOCUMENTS

| | | |
|---|---|---|
| 3,525,166 | 8/1970 | Rieker et al. . |
| 3,854,743 | 12/1974 | Hansen . |
| 4,308,674 | 1/1982 | Tessaro . |
| 4,611,414 | 9/1986 | Vogel . |
| 4,615,127 | 10/1986 | Delery . |
| 4,897,940 | 2/1990 | Sartor . |
| 4,955,940 | 9/1990 | Ottieri . |
| 4,959,912 | 10/1990 | Kaufman . |
| 5,062,226 | 11/1991 | Sartor et al. . |
| 5,068,984 | 12/1991 | Kaufman . |
| 5,088,211 | 2/1992 | Walkhoff . |
| 5,142,798 | 9/1992 | Kaufman . |

FOREIGN PATENT DOCUMENTS

| | | |
|---|---|---|
| 83002397 | 7/1993 | WIPO . |

*Primary Examiner*—Ted Kavanaugh

[57] ABSTRACT

The invention is the assembly of a flexible walking boot and a boot brace made of a rigid material for receiving and holding the boot within it so that the assembly can be used for downhill skiing or snowboarding. The brace has a sole plate for insertion into a conventional downhill ski or snowboard binding. Lateral support is provided by upright members extending along the leg from the sole plate of the brace. Forward resistance is provided by resilient bias means located at the pivotal attachment of the upright members to the brace, which attachment is preferably beneath the heel. The skier's heel is held down by means of an adjustable heel counter positioned at the rear of the brace.

28 Claims, 9 Drawing Sheets

DOWNHILL SNOW SPORT BOOT ASSEMBLY

This application is a continuation-in-part of Ser. No. 08/622,216 filed Mar. 27, 1996, abandoned.

The invention is a downhill snow sport boot assembly, comprising a boot brace into which a walking boot may be releasably secured. The boot brace may be inserted into a conventional binding for a downhill ski, snowboard or the like, and the assembly provides the user with the control and feel when skiing or snowboarding which is comparable to and in many ways better than that obtained using conventional boots.

The invention is an improvement of prior devices described in U.S. Pat. Nos. 4,959,912, 5,068,984 and 5,142,798. While these prior devices represented major advances in the art by providing the skier with a viable alternative to the conventional hard shell ski boot, these prior assemblies incorporated means for stabilizing the heel which were not altogether satisfactory, and the resistance to forward lean during skiing was provided by bias means located at the ankle which has also been found to be not wholly satisfactory. The use of a single such bias means on the outside portion of the device tended to produce a twisting torque during use, and the added bulk at the ankle region resulting from the location of the pivot point for the lateral support members of the brace increased the likelihood of interference between the devices during skiing.

The present invention addresses these and other shortcomings of prior embodiments and extends the utility of the invention to related snow sport activities, such as snowboarding. The invention gives the skier all of the essential advantages of a conventional hard shell boot with the further benefit of comfort provided by a flexible, insulated walking boot. While conventional plastic or composite boots require the boot material to provide the skier with medial and lateral stability by virtue of its rigidity, such boots must also allow for some forward flex during skiing, and they must be sufficiently flexible to allow for opening and closing the boot about the foot. Fulfilling these various requirements of support and flexibility necessitates the incorporation of various compromises in the structure, design and performance of a conventional hard shell ski boot. The invention departs from the conventional approach of using a single material to perform various functions by providing a device which separates the mechanical requirements for medial and lateral rigidity and resistance to forward flex from the requirements for flexibility to open and close the boot and to provide a comfortable environment for the foot.

Accordingly, the invention provides a downhill snow sport boot assembly, comprising a flexible walking boot and a boot brace made of a rigid material for receiving and holding the boot within it. The boot brace has a sole plate with toe and heel portions adapted to be insertable into a downhill ski or snowboard binding. A forefoot receiving means is attached to the toe portion of the sole plate for receiving the toe of the boot. Inner and outer lateral support members are pivotally attached to and extend upwardly from the heel portion of the sole plate, so that the support members extend laterally along the leg shaft of the boot positioned therein. Resilient bias means are attached to the sole plate at the pivotal attachment of the lateral support members. The resilient bias means provide a gradient of resistance to the forward rotation of the lateral support members. Releasable adjustable instep securement means extend across the boot brace for securing the boot therein, and releasable adjustable leg shaft securement means extend across an upper portion of the lateral support members for securing the leg shaft of the boot. Heel hold down means at the rear of the brace secure the heel of the boot in the brace. The heel hold down means comprise a rigid heel counter which is attached to the boot brace, the counter having means for firmly engaging a rear portion of the boot to hold the heel against the sole plate during skiing.

Figure 1:
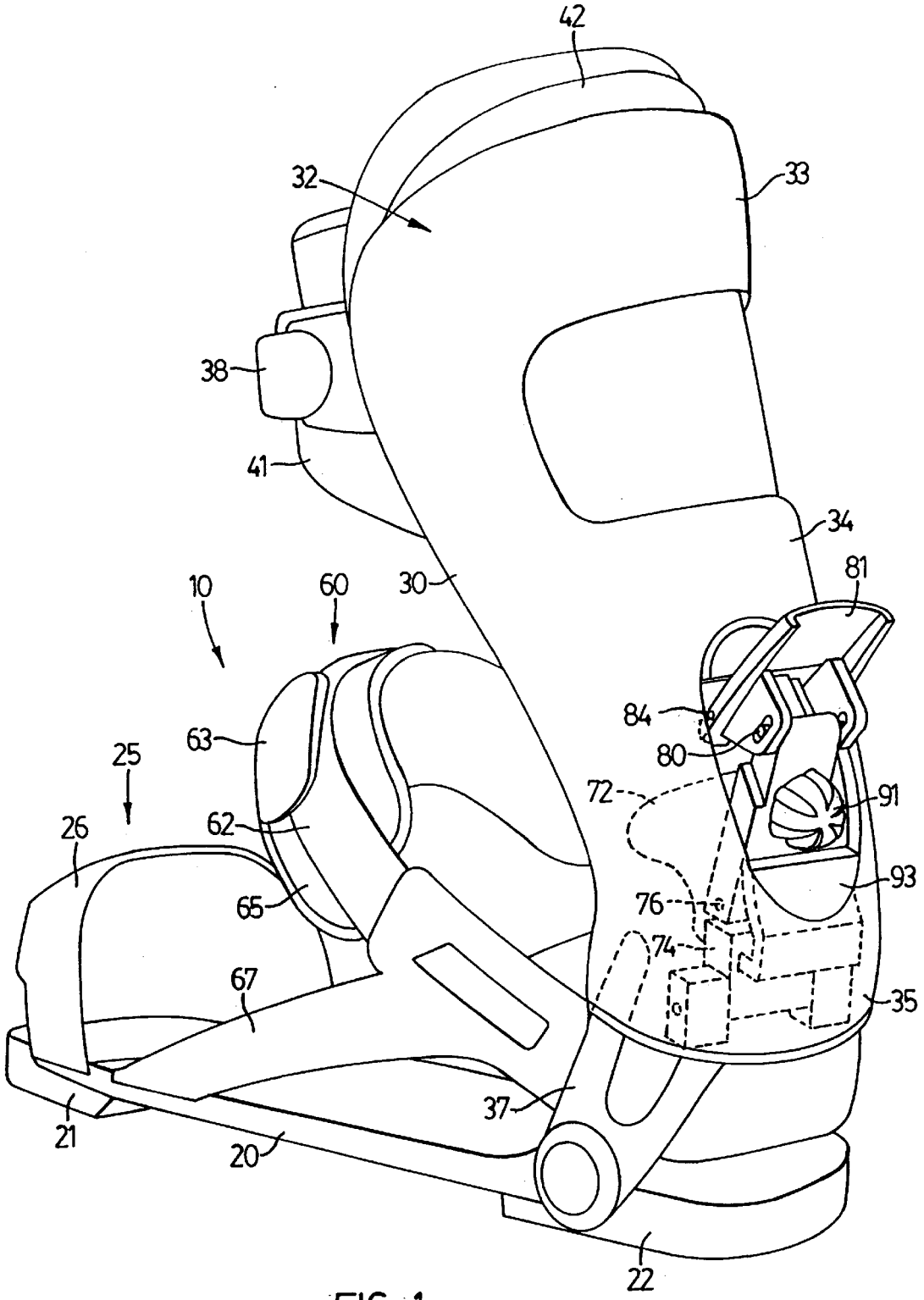
FIG. 1 is a rear perspective view of a first preferred embodiment of the invention in which the lateral support members are pivotally attached to the sole plate beneath the heel of the boot.
Figure 2:
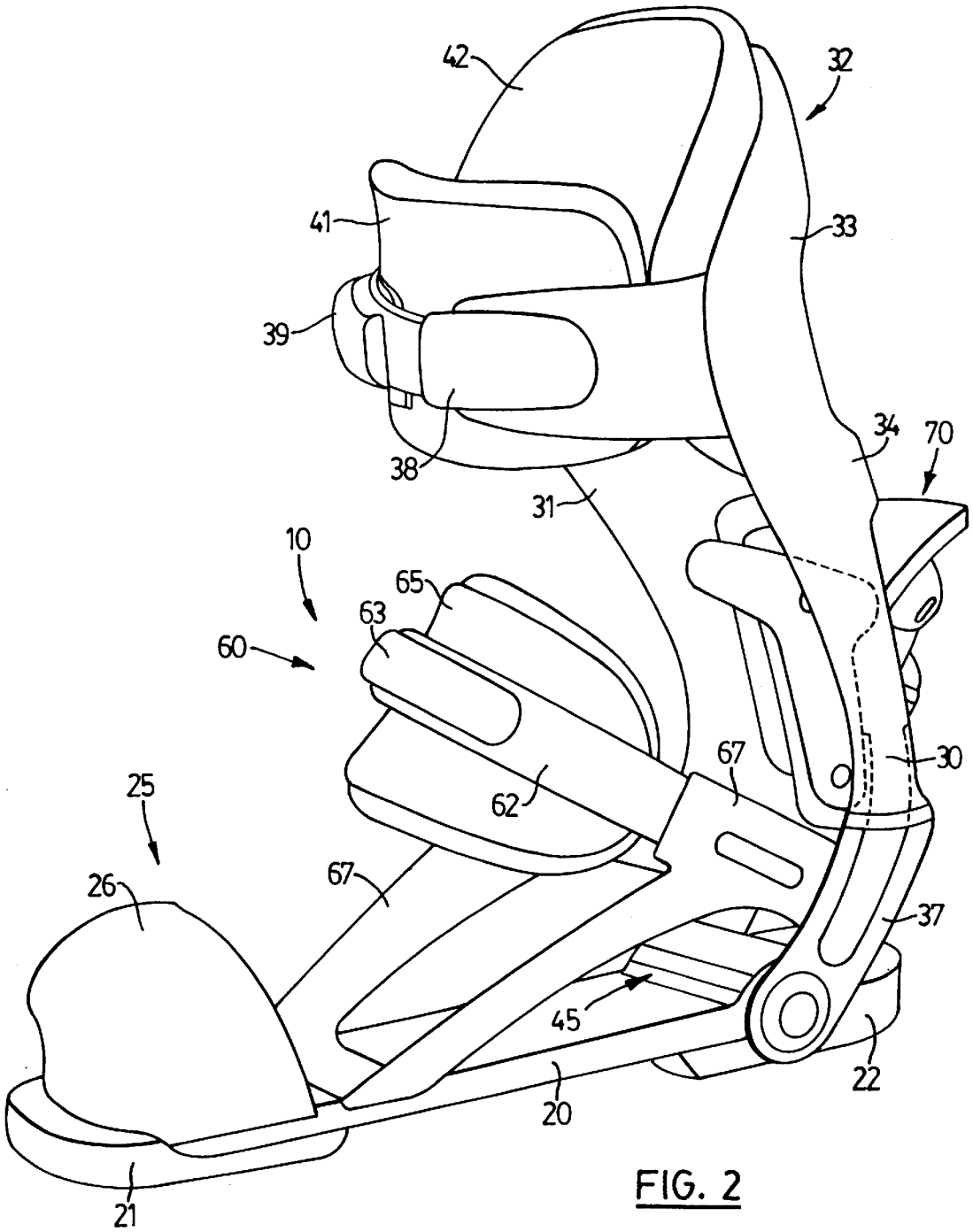
FIG. 2 is a front perspective view of the first embodiment.
Figure 3:
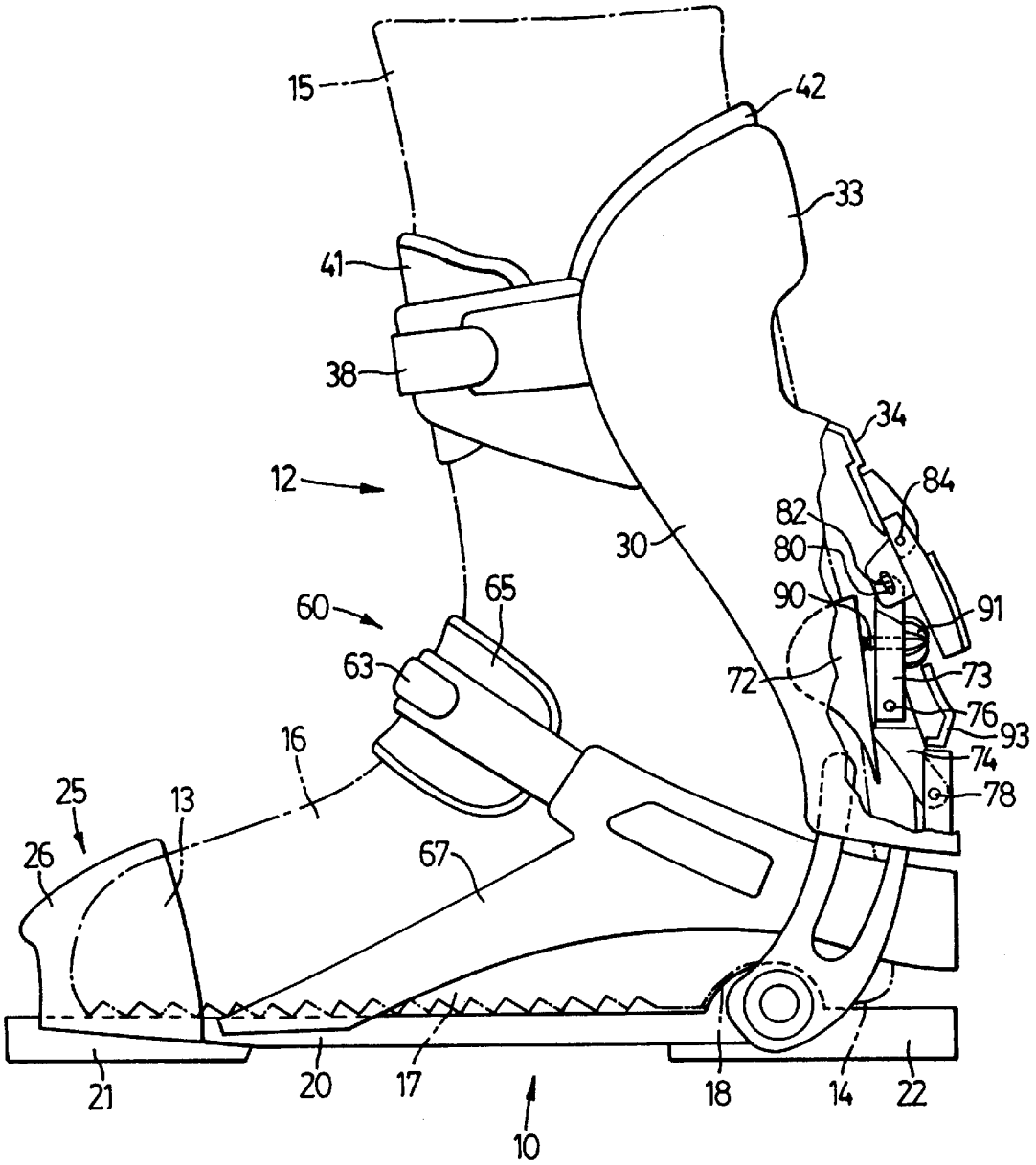
FIG. 3 is a side elevation of a boot and boot brace of the invention as assembled.

A first preferred embodiment of the improved downhill snow sport boot assembly of the invention is shown in FIGS. 1–3. A boot brace 10 provides a structure into which a flexible boot 12 may be releasably inserted. While the boot 12 is designed to fit the structure of the brace 10, the boot 12 is not of a radically different construction than that of many ordinary winter boots. Thus, the boot 12 has a toe 13, a heel 14, a leg shaft 15, and a forefoot portion or vamp 16. For use in association with the boot brace 10, the boot 12 has a sole 17 provided with a transverse groove 18 beneath the heel 14 to accommodate structure in the brace 10 described below.

The boot brace 10 has an elongate sole plate 20 which is made of a rigid material, preferable a lightweight moldable thermoplastic or composite material. The sole plate 20 has toe 21 and heel 22 portions shaped to fit into and to be releasably secured by a standard downhill ski binding. The sole plate 20 may also be formed to fit into and to be releasably secured by a standard snowboard binding.

The brace 10 has a forefoot receiving means 25 for accepting and holding the toe portion 13 of the boot 12. The forefoot receiving means 25 may simply be a curved toe cap 26 molded integrally with the sole plate 20. The purpose of the forefoot receiving means 25 is to provide a releasable securement of the toe portion 13 of the boot 12 in the brace 10. It will be apparent to the skilled person that this objective may be achieved using various structures.

In a conventional downhill ski boot, the rigid structure of the boot shell provides the skier with the ability to exert control over the ski during use. Thus, such rigid structure enables the skier to have edge control during skiing by providing means for the transverse tilting of the ski in response to the movement of the lower leg of the skier. Without the leverage provided by the rigid boot, the downhill skier does not have the ability to execute quick turns such as those required in the parallel skiing technique. As a result, such a downhill skier would be required to negotiate the slope in a slower fashion for safety, much like a cross country skier. Similarly, a snowboarder exerts control over the snowboard by means of the rigid binding and structural stiffness of the snowboarding boot.

In relation to downhill skiing, the invention provides a rigid structure in the boot brace 10 which allows the skier to exert control over the ski during skiing in the same fashion and with the same feel as is possible using a conventional hard ski boot. Thus, the boot brace 10 of invention has inner and outer lateral support members 30 and 31 which are pivotally attached to and extend upwardly from the heel portion 22 of the sole plate 20. As shown in FIGS. 1–3, it is preferred that the lateral support members 30 and 31 extend upwardly and are joined to one another about the rear of the leg shaft 15 of the boot 12 by curved transverse members 33, 34 and 35, but clearly, alternative arrangements of the support members 30 and 31 in relation to the leg shaft 15 are possible, and are within the scope of the invention. Likewise, in this embodiment of the invention, the point of pivotal attachment of the lateral support members 30 and 31 is in the sole plate 20 beneath the heel of the skier. However, as will be seen from the description of a second embodiment of the invention, the lateral support members 30 and 31 may be attached in alternative locations in the heel portion 22 of the sole plate 20. Thus, the heel portion 22 should be understood to include for the purposes of this disclosure the area about the heel of the boot brace 10, including to the rear and generally beneath the heel 14 of a boot 12 inserted in the brace 10.

It is preferred that the support members 30 and 31 are formed as a single unit 32 including transverse members, such as the transverse members 33–35. The support member unit 32 may be conveniently molded from a thermoplastic or composite material, such as a lightweight carbon fibre composite material. The lateral support members 30 and 31 must have sufficient strength and rigidity to provide the skier with the requisite leverage in relation to the ski so that the desired edge control during skiing can be readily achieved. In this regard, the support members 30 and 31 must be shaped so that they are positioned substantially along the inner and outer lateral portions of the skier's lower leg.

It is presently preferred to provide the lateral support members 30 and 31 with a lower portion 37 made of metal such as stainless steel. In this arrangement, the lateral support unit 32 is formed with cavities at the lower ends of the members 30 and 31 for receiving the metal lower portions 37, or the unit 32 may simply be molded about and thereby secured to the metal lower portions 37. It has been found that the combination of a rigid metal lower portion 37 with a plastic or composite upper portion 32 provides a number of benefits from a design and functional point of view. Thus, the use of metal and plastic or composite materials allows for the support unit 32 to be either rigid like the metal lower portion 37 or to have some degree of give to provide an improved feel to the skier during use.

The lateral support members 30 and 31 are releasably securable about the leg shaft 15 of the boot 12 by means of a strap 38 and closure device such as a buckle 39 to provide adjustability to the securement. The strap 38 is threaded through a shin pad 41 which serves to disperse the forces at the shin of the skier during skiing. Likewise the support member unit 32 is preferably equipped with a calf pad 42 positioned in front of the upper transverse member 33.

Conventional downhill ski boots provide the skier with the ability to lean into the slope of the hill by allowing a degree of forward flex or give in the boots. The ability to pivot the lower leg even a few degrees forwardly during skiing provides an essential element of control by enabling the skier to maintain his weight over the skis. The present invention provides this forward lean capability through the use of a resilient bias means 45 attached to the sole plate at the pivotal attachment of the lateral support members 30 and 31, which is preferably through the lower metal portions 37. While the resilient bias means 45 may comprise a variety of structures, the presently preferred means is a torsion spring device such as that shown in FIGS. 4–6. Thus, the preferred bias means 45 comprises a torsion spring having and outer tubular member 47, an inner tubular member 48, and an intermediate elastomeric tubular member 49 which is bonded to both the outer and inner members 47 and 48. Preferably, the elastomer 48 is a rubber material having a thickness of about 1/16 of an inch (1.6 mm). The outer tubular member 47 is fixed, for example, by molding, into a plate 51 which in turn is mechanically securable to the sole plate 20 of the brace 10. The inner tubular member 48 has a plurality of flat longitudinal interior surfaces 52 which in cross section preferable form a regular geometric shape, such as a hexagon. A rod 53 having mating longitudinal flat outer surfaces is insertable into the tubular member 48, so that rotation of the rod 53 about its longitudinal axis causes rotation of the inner member 48 relative to the outer member 47, which rotation is opposed by the elastomeric member 49.

Figure 4:
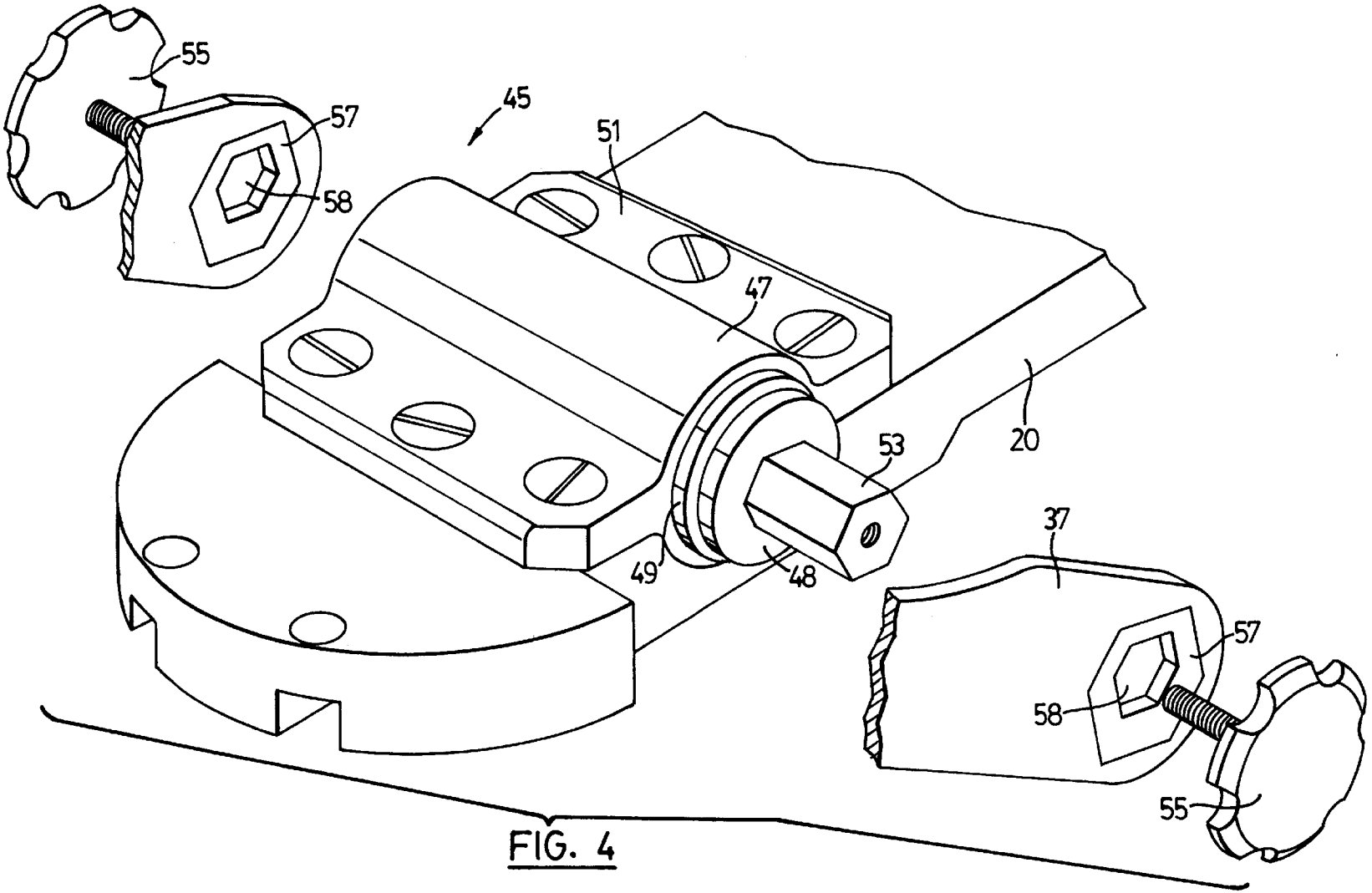
FIG. 4 is an exploded detail view of a preferred resilient bias means and lateral support member attachment means for the first embodiment.

A preferred assembly for the torsion spring 45 and lateral support members 30 and 31 in this embodiment is shown in FIG. 4. The hexagonal rod 53 is sized to extend slightly beyond either end of the torsion spring 45, and each lower portion 37 of the lateral support members is provided with a hexagonal opening sized to fit over and engage an end of the rod 53. The rod 53 is tapped with an internal thread to receive a cap screw 55 at each end to secure each lower lateral support portion 37 in place.

As will be apparent to the skilled person, the foregoing assembly for the lateral support members 30 and 31 to the torsion spring 45 is just one of several possible arrangements within the scope of the present invention.

Figure 5:
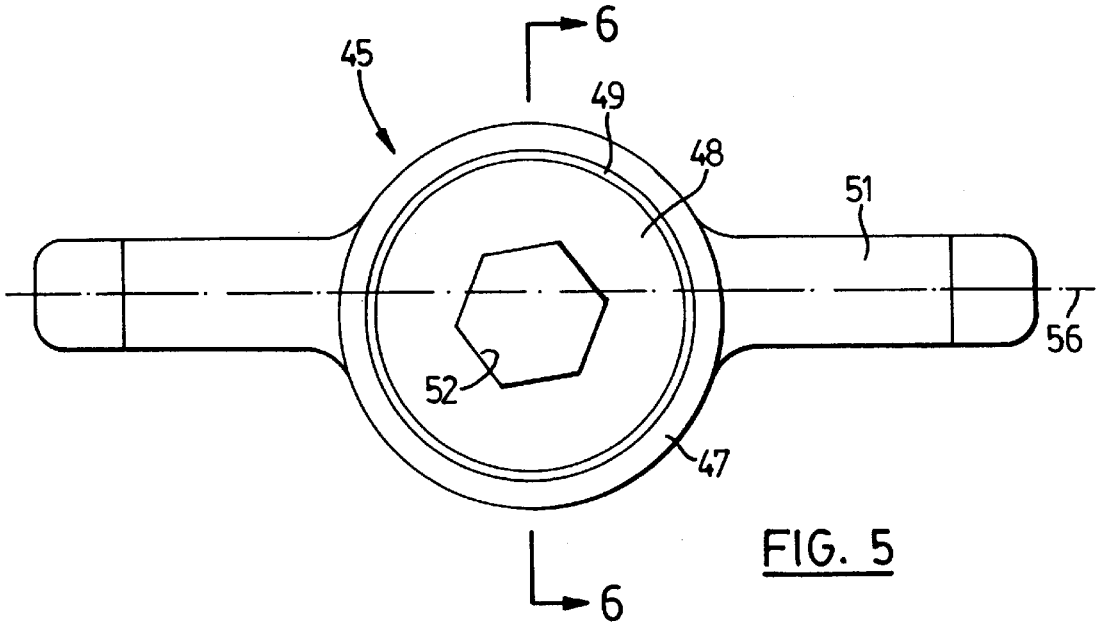
FIG. 5 is a side elevation of the preferred bias means shown in FIG. 4.
Figure 6:
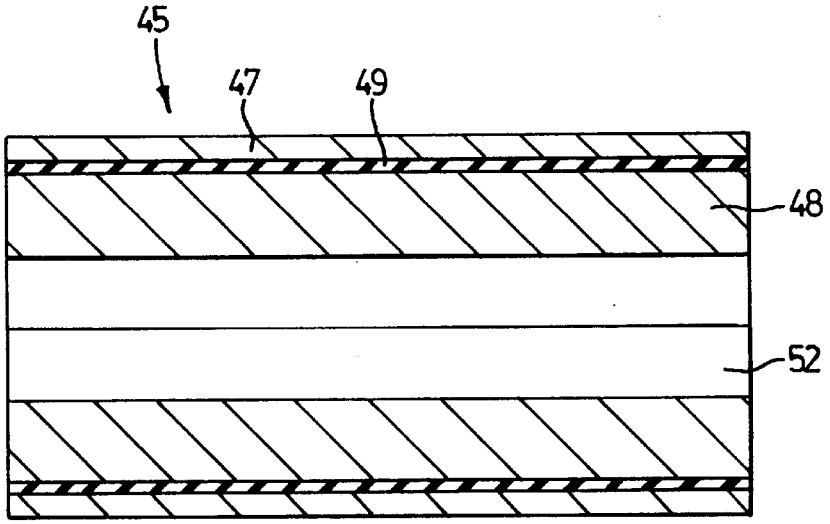
FIG. 6 is a cross sectional view of the device shown in FIG. 5.
Figure 7:
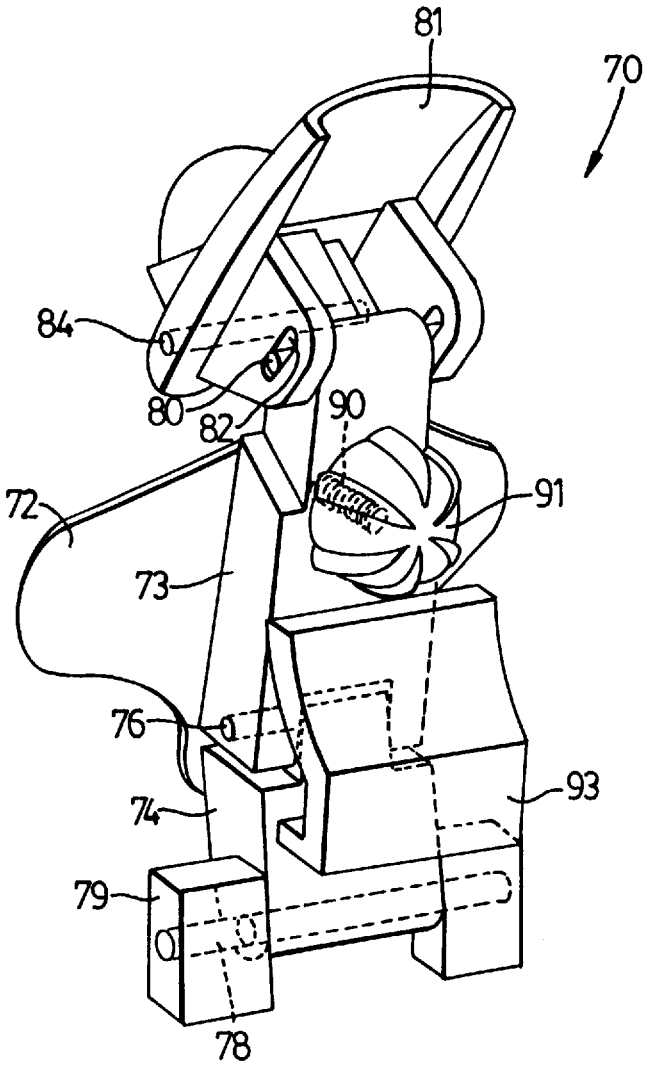
FIG. 7 is a rear perspective view of a preferred heel hold down device for use in the invention.

It is desirable to attach the lateral support members 30 and 31, preferably as the unit 32, so that there is a degree of preloading of the torsion spring 45 when the support unit 32 is secured to the skier's leg. It has been found that a desirable amount of forward flex for the skier's lower leg should be limited to about 12°. Also, the amount of resistance to forward lean which the skier feels should increase steadily and rapidly. Clearly, the torsion spring 45 can be tailored to the various needs of skiers, but for most downhill skiing conditions, the use of a spring 45 having a loading force or torque which proceeds essentially linearly from 0 ft. lbs. at a 0° rotation of the rod 53 relative to the fixed outer tube 47, to 25–35 ft. lbs. at 5°, and 80–90 ft. lbs. at 12°, has been found to be suitable. The torsion spring 45 can be readily preloaded with a desired forward resistance or torque by manufacturing the spring 45 so that the inner tubular member 48 is rotated a desired amount relative to the outer tubular member 49 as gauged by the orientation of the geometric shape of the inner flat surfaces of the inner member 48 relative to the plane 56 of the plate 51 (FIG. 5). This offset or preload angle for the torsion spring 45 relative to the neutral position is typically in the range of 5°–10°, preferably about 7°. The average amount of torque preload in this regard is 30–60 ft. lbs., but it can be varied as circumstances require by simply adjusting the manufacture of the spring 45 accordingly. Because there is a certain amount of forward give inherent in the boot 12 and shin pad 41, and because the centres of rotation are at different locations, the torsion spring 45 normally moves within about a 5° range, whereas the skier's lower leg may actually pivot up to about 10° about his ankle.

The human leg usually has some curvature along its length, so it is desirable to have an adjustment means for the lateral support unit 32 to accommodate such curvature. As shown in FIG. 4, each lower support portion 37 has a removable hexagonal bushing 57 which in turn has an off center hexagonal opening 58 for receiving the end of the rod 53. Bushings 57 on opposing lower support portions 37 may thus be oriented to provide some inward or outward tilt to the lateral support unit 32 as attached to the torsion spring 45, thereby compensating partly or wholly for the leg curvature of the user.

Providing the lateral support unit 32 with the proper degree of tilt assists the skier in maintaining his knee over the ski during skiing. This transverse tilt feature and the application of a torque preload to the torsion spring 45 provides the skier support and stability over the ski when the boot 12 is fastened into the brace 10.

After insertion of the toe 13 of the boot 12 into the toe cap 26, the forefoot 16 of the boot 12 is secured in the brace 10 by a releasable securement means 60. As shown in FIGS. 1 and 2, the securement means 60 is preferably a strap 62 and buckle 63 arrangement which includes a forefoot pad 65. The ends of the strap pieces 62 are attached to lateral members 67 extending along both sides of the foot of the boot 12 and behind the heel 14. As shown, the lateral members 67 may conveniently be formed of a single piece of plastic or composite material and attached to the sole plate 20 of the brace 10.

While the leg straps 38 and forefoot straps 62 secure the boot 12 in the brace 10, the skier will still experience some up and down movement of the boot heel 14 during skiing if the brace 10 is not provided with a means for holding the boot heel 14 against the sole plate 20. Since such up and down movement of the boot heel 14 during skiing is quite undesirable, the invention includes a heel hold down means 70 for securing the boot heel 14 against the sole plate 20.

The skilled person will appreciate that there are a variety of devices which may be suitably employed to achieve the objective of holding the boot heel 14 in place during skiing, and a preferred device for use in the present embodiment is shown in FIGS. 1–3, and 7.

A first preferred heel hold down means 70 comprises an adjustable heel counter 72 which is positioned behind and preferably above the heel 14 so that upon engagement with the boot 12, it wraps around the heel 14 at a downward angle. The counter 72 should be of a fairly stiff material to provide firm engagement with the heel 14. As shown, the counter 72 is attached to an arm 73 which is part of a pivotally linked pair of arm members 73 and 74. The hinged cojoining of the arms 73 and 74 may be accomplished in a variety of ways, such as by means of a pin 76. The lower end of the arm 74 is pivotally attached by a pin 78 to a receiving structure 79 formed in the lower transverse member 35 of the support unit 32. The upper end of the arm 73 is pivotally attached by a pin 80 to a lever 81 having slots 82 for receiving the pin 80. The lever 81 is in turn pivotally attached to the middle transverse member 34 of the unit 32 by means of a pin 84. This arrangement provides a linkage for allowing the heel counter 72 to move into and away from engagement with a boot 12 positioned in the brace 10.

It is preferable to provide a fine adjustment of the engagement of the counter 72 with the heel 14. One means for accomplishing this objective is by attaching the upper portion of the counter 72 to a screw 90 having a nob 91 which is threaded through the arm 73. Adjustment of the screw 90 using the nob 91 causes the counter 72 to move in and out relative to the heel 14.

It is also important to restrict the rearward movement of the lower pivot arm 74 so that the heel hold down means 70 may provide support at the rear of the boot 12. Thus, it is preferred that a stop 93 be attached to the transverse member 35 to limit the rearward movement of the lower pivot arm 74 when the lever 81 is closed (see FIG. 3).

Figure 8:
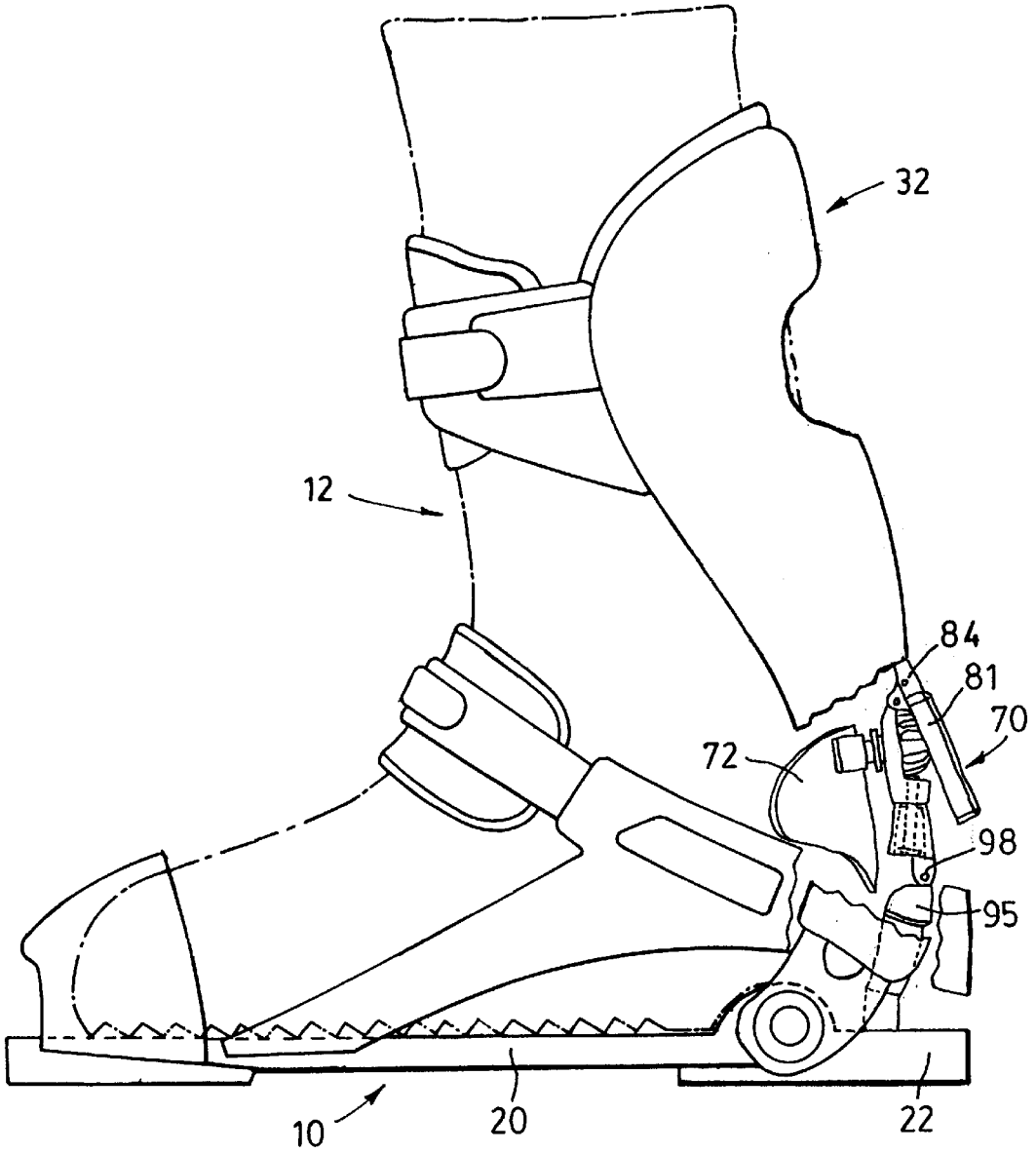
FIG. 8 is a side elevation of a boot and boot brace of the invention as assembled showing an alternative heel hold down device.
Figure 9B:
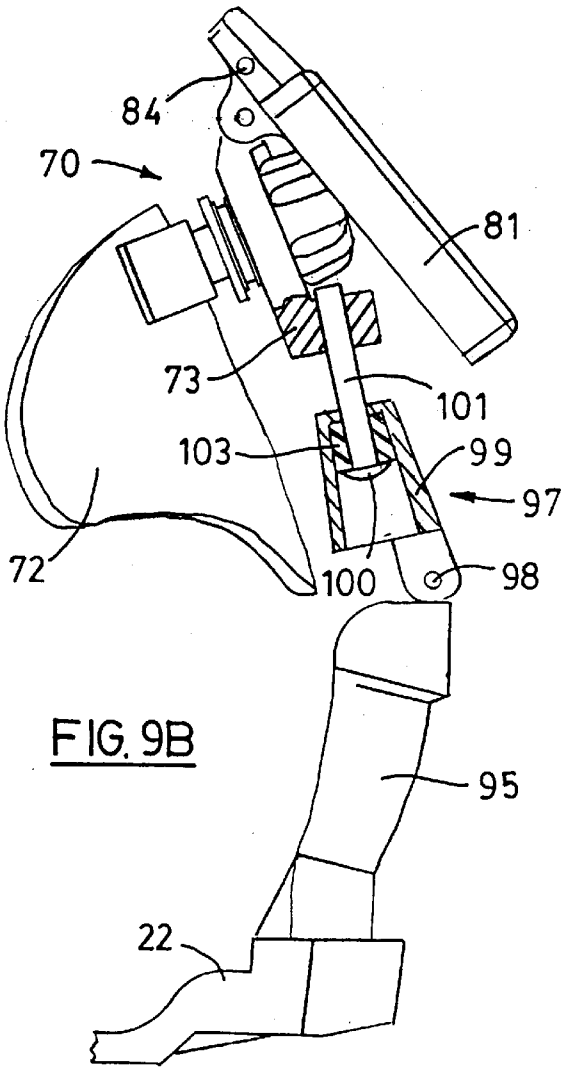
FIG. 9B is a detail view of the device of FIG. 9A showing the heel hold down device in the forward lean position.
Figure 9A:
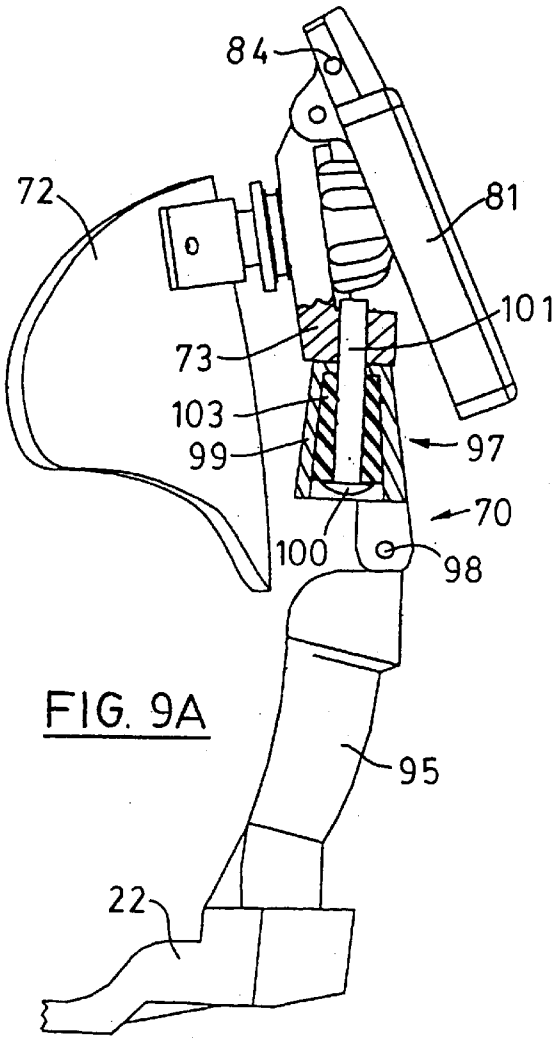
FIG. 9A is a side elevation detail view showing the alternative heel hold down device for the boot brace in the neutral position.

A second preferred embodiment of the heel hold down means 70 is shown in FIGS. 8 and 9. This embodiment of the invention includes a heel riser 95 affixed to the heel portion 22 of the sole plate 20. A spring loaded resistance means 97 is pivotally attached to an upper portion of the heel riser 95 by means of a pin 98, and the lever 81 is pivotally attached to the support unit 32 by the pin 84.

The resistance means 97 comprises a housing 99 containing a piston 100 having a rod 101 extending through the housing 99 and attached to the arm 73 carrying the heel counter 72. The piston 100 moves in the housing 99 in response to the forward and rearward leg movement of the skier. A spring means, such as an elastomer 103, is positioned in the housing 99 to coact with the piston to provide resistance to the forward lean of the skier's leg. Thus, the resistance means 97 supplements the resistance force provided by the bias means 45 located beneath the heel portion 14 of the boot 12.

The inclusion of the spring loaded resistance means 97 in the boot assembly of the invention provides several advantages. The resistance means 97 can function as a fine adjustment for the total forward lean resistance of the device 10 provided by the bias means 45 and the resistance means 97. It is more economic to provide an appropriate spring or elastomer 103 to the resistance means 97 for the purpose of increasing or decreasing the resistance force to forward lean, than it is to replace the bias means 45 with one having a different resistance profile. The resistance means 97 can be sized to allow for a greater or lesser degree of forward lean. The limit of travel of the piston 100 defines the limit of forward lean. Thus, both the range and the extent of forward movement of the support unit 32 are governed by the structure of the resistance means 97.

The first preferred embodiment of the invention is readily used by simply stepping into the boot brace 10 by first engaging the toe 13 of the boot 12 with the toe cap 26, followed by seating the torsion spring 45 in the transverse groove 18 of the boot heel 14. The forefoot and leg straps 62 and 38 are fastened, and the heel counter 72 is engaged against the heel portion 14 of the boot 12 by closing the lever 81. With the boot 12 thus secured in the brace 10 and the sole plate 20 of the brace 10 fastened in the binding of the ski or snowboard, the user is ready to commence a downhill run. The device of the invention so assembled will provide the skier with the same feel and control provided by a conventional hard shell ski boot. Using the invention, however, the skier can release the boot 12 from the brace 10 when he is finished skiing and walk normally as the boot 12 is of a flexible construction.

Figure 10:
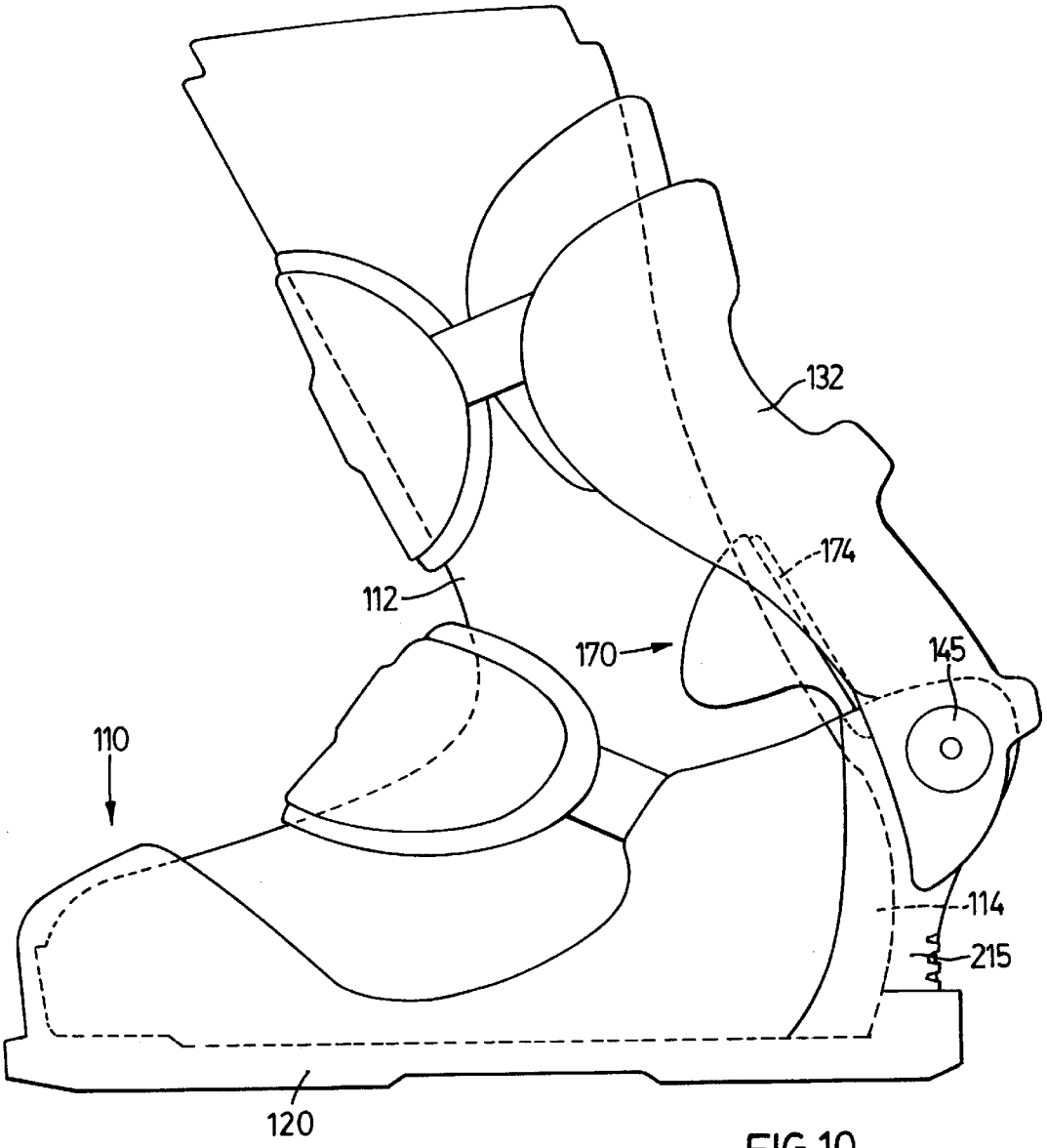
FIG. 10 is a side elevation of a second embodiment of the invention wherein the bias means is located behind the heel of the boot.

A second preferred embodiment of the invention is shown in FIG. 10. In this embodiment, the resilient bias means 145 is positioned rearwardly of the boot heel 114 in a heel riser 215 attached to the sole plate 120. Again, the bias means is preferably a torsion spring of the type described. The pivotal attachment of the lateral support unit 132 is also behind the heel 114 at the torsion spring 145. An advantage of this arrangement is that the boot 112 does not need to be specially adapted to fit the brace 110. Locating the torsion spring 145 behind the heel 114 precludes the need to use a boot with a transverse groove in the sole beneath the heel as was the case for the first embodiment described.

The heel hold down means 170 of the second embodiment may simply be a counter 172 attached to a stiffly resilient member, such as a band of spring steel 174, which firmly biases the counter into engagement with the rear of the boot 112 when it is secured in the brace 110.

The remaining features of the second embodiment of the invention are as described previously. The use of this embodiment is also similar to that described.

While the foregoing description has been directed to preferred embodiments of the invention, the skilled person will appreciate that the scope of the invention covers a variety of equivalent structures. Accordingly, the scope of the invention is intended to be covered particularly by the following claims.

We claim:

1. A downhill snow sport boot assembly, comprising:

a boot made of flexible materials allowing the wearer to walk normally, the boot having sole, toe, heel, and forefoot portions, and a leg shaft; and a boot brace made of rigid material for receiving and holding the boot within it, the boot brace having a sole plate with toe and heel portions, the sole plate being adapted to be insertable into a downhill ski or snowboard binding, and a boot receiving structure, comprising:

a forefoot receiving means attached to the toe portion of the sole plate for receiving and holding the toe of the boot in the brace;

inner and outer rigid lateral support members pivotally attached to and extending upwardly from the heel portion of the sole plate so that the support members extend laterally along the leg shaft of the boot positioned in the brace;

resilient bias means attached to the heel portion of the sole plate at the pivotal attachment of the lateral support members, said pivotal attachment being beneath the heel portion of the boot, the resilient bias means providing a gradient of resistance to the forward rotation of the lateral support members;

releasable adjustable forefoot securement means extending across the boot brace for securing the forefoot portion of the boot in the brace;

releasable adjustable leg shaft securement means extending across an upper portion of the lateral support members for securing the leg shaft of the boot in the brace; and heel hold down means at the rear of the brace for securing the heel of the boot in the brace, the heel hold down means comprising a stiff heel counter being attached to means for firmly engaging a rear portion of the boot to hold the heel against the sole plate during use.

2. A downhill snow sport boot assembly as claimed in claim 1, wherein the forefoot receiving means is a toe cap convexly curved over and attached to the sole plate, the toe cap and sole plate defining a space for receiving and holding the toe of the boot.

3. A downhill snow sport boot assembly as claimed in claim 1, wherein the inner and outer lateral support members include a transverse member joining them together to form a unit.

4. A downhill snow sport boot assembly as claimed in claim 1, wherein the inner and outer lateral support members each include a lower portion which is pivotally attached to the sole plate.

5. A downhill snow sport boot assembly as claimed in claim 4, wherein the lateral support members are made of a plastic or composite material and the lower portions are made of metal.

6. A downhill snow sport boot assembly as claimed in claim 1, wherein the resilient bias means comprises inner and outer parts which co-act with at least one elastomeric member positioned between said inner and outer parts to produce an elastomeric force from the elastomeric member upon rotation of the inner and outer parts relative to one another.

7. A downhill snow sport boot assembly as claimed in claim 6, wherein the resilient bias means is a cylindrical torsion spring having outer and inner tubular members between which an elastomer is bonded to each member.

8. A downhill snow sport boot assembly as claimed in claim 7, wherein the tubular members are metal and the elastomer is a rubber material.

9. A downhill snow sport boot assembly as claimed in claim 7, wherein the inner tubular member has a plurality of flat longitudinal interior surfaces, and the torsion spring further comprises a rod being sized to fit within the inner tubular member and having flat longitudinal exterior surfaces which are engagable with the interior surfaces of the inner member.

10. A downhill snow sport boot assembly as claimed in claim 9, wherein the rod has ends extending beyond the inner and outer tubular members.

11. A downhill snow sport boot assembly as claimed in claim 7, wherein the outer tubular member of the torsion spring is fixed into a plate which is releasably attachable to the sole plate to hold the outer tubular member of the torsion spring stationary.

12. A downhill snow sport boot assembly as claimed in claim 10, wherein the inner and outer lateral support members have openings with internal flat surfaces sized to fit over and engage the ends of the rod so that the rod may be rotated by the attached lateral support members.

13. A downhill snow sport boot assembly as claimed in claim 12, wherein the rod ends are tapped to provide a screw receiving internal thread, and the lateral support members are secured to the rod ends by cap screws.

14. A downhill snow sport boot assembly as claimed in claim 1, wherein the boot brace further comprises a pair of lateral members attached to and extending upward from opposing sides of the sole plate and wherein the releasable adjustable instep securement means is attached to the lateral members and comprises a strap, buckle and forefoot pad arrangement.

15. A downhill snow sport boot assembly as claimed in claim 3, wherein the lateral support unit comprises a transverse member joining upper ends of the inner and outer support members, said transverse member being curved to conform to the shape of a skier's calf, and wherein a calf pad is attached to said transverse member.

16. A downhill snow sport boot assembly as claimed in claim 15, wherein the releasable adjustable leg shaft securement means comprises a strap, buckle and shin pad arrangement attached to the lateral support unit.

17. A downhill snow sport boot assembly as claimed in claim 3, wherein the heel hold down means is attached to the lateral support unit.

18. A downhill snow sport boot assembly as claimed in claim 17, wherein the heel hold down means comprises a heel counter which is attached to an arm having upper and lower portions which are hinged together, the lower arm portion being pivotally attached to the lateral support unit and the upper arm portion being pivotally attached to a lever which in turn is pivotally attached to the lateral support unit, thereby forming a linkage which causes the heel counter to move into engagement or disengagement with the heel of the boot through manipulation of the lever.

19. A downhill snow sport boot assembly as claimed in claim 18, wherein the counter has an upper portion which is attached to a screw having a nob, the screw being threaded through the upper arm portion, so that rotation of the screw using the nob provides a fine adjustment of the engagement pressure of the counter against the boot.

20. A downhill snow sport boot assembly as claimed in claim 3, wherein a heel riser is attached to and extends upwardly from the heel portion of the sole plate; the heel hold down means comprises a spring loaded resistance means pivotally attached to the heel riser and a heel counter attached to an arm having a lower end attached to the resistance means and an upper end being pivotally attached to a lever arm which in turn is pivotally attached to the lateral support unit, whereby the forward movement of the lateral support unit is progressively resisted and the extent of such movement is limited by the spring loaded resistance means.

21. A downhill snow sport boot assembly as claimed in claim 20, wherein the counter has an upper portion which is attached to a screw having a nob, the screw being threaded through the arm carrying the counter so that rotation of the screw using the nob provides a fine adjustment of the engagement pressure of the counter against the boot.

22. A downhill snow sport boot assembly as claimed in claim 20, wherein the resistance means comprises a housing containing a piston having a rod extending through the housing and attached to the lower end of the arm carrying the heel counter; a spring means is positioned in the housing to coact with the piston to provide resistance to the forward movement of the lateral support unit, the housing and rod being sized to define the extent and limit of such forward movement.

23. A downhill snow sport boot assembly as claimed in claim 22, wherein the spring means is an elastomer.

24. A downhill snow sport boot assembly, comprising:

a boot made of flexible materials allowing the wearer to walk normally, the boot having sole, toe, heel, and forefoot portions, and a leg shaft; and a boot brace made of rigid material for receiving and holding the boot within it, the boot brace having a sole plate with toe and heel portions, the heel portion having a heel riser attached to and extending upwardly from it, the sole plate being adapted to be insertable into a downhill ski or snowboard binding, and a boot receiving structure, comprising:

a forefoot receiving means attached to the toe portion of the sole plate for receiving and holding the toe of the boot in the brace;

inner and outer rigid lateral support members pivotally attached to and extending upwardly from the heel riser so that the support members extend laterally along the leg shaft of the boot positioned in the brace;

resilient bias means attached to the heel riser at the pivotal attachment of the lateral support members, said pivotal attachment being behind the heel portion of the boot, the resilient bias means providing a gradient of resistance to the forward rotation of the lateral support members;

releasable adjustable forefoot securement means extending across the boot brace for securing the forefoot portion of the boot in the brace;

releasable adjustable leg shaft securement means extending across an upper portion of the lateral support members for securing the leg shaft of the boot in the brace; and heel hold down means at the rear of the brace for securing the heel of the boot in the brace, the heel hold down means comprising a stiff heel counter being attached to means for firmly engaging a rear portion of the boot to hold the heel against the sole plate during use.

25. A downhill snow sport boot assembly as claimed in claim 24, wherein the inner and outer lateral support members include a transverse member joining them together to form a unit.

26. A downhill snow sport boot assembly as claimed in claim 24, wherein the resilient bias means comprises inner and outer parts which co-act with at least one elastomeric member positioned between said inner and outer parts to produce an elastomeric force from the elastomeric member upon rotation of the inner and outer parts relative to one another.

27. A downhill snow sport boot assembly as claimed in claim 26, wherein the resilient bias means is a cylindrical torsion spring having outer and inner tubular members between which an elastomer is bonded to each member.

28. A downhill snow sport boot assembly as claimed in claim 24, wherein the heel hold down means comprises a heel counter which is attached to a stiffly resilient member which biases the counter into firm engagement with the rear of the boot when the boot is secured in the brace.

* * * * *